United States Patent [19]

Meyer et al.

[11] Patent Number: 4,729,191

[45] Date of Patent: Mar. 8, 1988

[54] CUTLERY SHARPENING APPARATUS

[75] Inventors: Dennis J. Meyer; Richard J. Law, both of Louisville, Ky.

[73] Assignee: Den-Dic, Inc., Louisville, Ky.

[21] Appl. No.: 901,796

[22] Filed: Aug. 29, 1986

[51] Int. Cl.[4] ..... B24B 3/54

[52] U.S. Cl. ..... 51/83 BS

[58] Field of Search ..... 51/84 R, 83 R, 83 BS, 51/84 BS, 85 R, 85 BS, 94 R

[56] References Cited

U.S. PATENT DOCUMENTS

| | | | |
|---|---|---|---|
| 1,970,000 | 8/1934 | Dunbar | 51/94 R |
| 2,435,671 | 2/1948 | Clark | 51/158 |
| 2,456,482 | 12/1948 | Barnerd | 51/83 R |
| 2,475,455 | 7/1949 | Nicholas | 51/83 BS |
| 2,688,213 | 9/1954 | Dyer | 51/94 R |

*Primary Examiner*—Harold D. Whitehead

*Attorney, Agent, or Firm*—Ralph B. Brick

[57] ABSTRACT

Cutlery sharpening method and apparatus for sharpening a cutlery blade edge wherein the blade edge to be sharpened is pivoted into and yieldingly moved along a blade sharpening surface when moved in one direction and pivoted out of and moved above the blade sharpening surface when moved in an opposite direction.

10 Claims, 7 Drawing Figures

CUTLERY SHARPENING APPARATUS

BACKGROUND OF THE INVENTION

The present invention relates to an improved cutlery sharpening apparatus and method of sharpening a cutlery blade and more particularly to an improved apparatus and method for holding and moving cutlery blade edges to be sharpened relative abrasive grinding surface means, the cutlery blades being of various sizes and shapes.

It has long been known in the cutlery art to utilize machinery to hold a cutlery blade in contact with an abrasive surface and move one relative the other to sharpen the blade edge by abrasive grinding. For example, U.S. Pat. No. 2,435,671, issued to Earl W. Clark et al. on Feb. 10, 1948, teaches a knife holding device which brings a knife blade into grinding contact with an abrasive surface and maintains such contact while moving the blade relative the surface at a substantially fixed angular relation. U.S. Pat. No. 2,456,482, issued to H. W. Barnard et al. on Dec. 14, 1948, teaches a knife blade grinding machine which disposes a knife blade between movable grinding wheels throughout all phases of blade movement and which automatically tilts the knife blade as it reciprocates relative the moving grinding gap. And, U.S. Pat. No. 2,475,455, issued to H. T. Nicholas on July 5, 1949, teaches a knife blade grinding machine which also disposes a knife blade between movable grinding wheels which wheels move consequent to reciprocating motion of the knife blade, the contour of the blade finish being controlled by a follower cam.

The apparatus as taught by these patents and by other known prior cutlery sharpening machines and as taught by previous cutlery sharpening methods have been comparatively complex and costly in manufacture, assembly, and maintenance and in operational steps, often requiring numerous parts which have had to be machine tooled with precision care and which nevertheless have led to frequent wear and concomitant maintenance problems. Furthermore, the apparatus and methods of the prior art have been limited in the types and shapes of cutlery blades which could be sharpened efficiently thereby and have often required complex and numerous steps in the blade sharpening processes involved.

The present invention, recognizing the limitations in the apparatus and methods of prior art, provides a straightforward, economical and efficient method and apparatus, the invention disclosed herein being inexpensive yet efficient in manufacture, assembly, maintenance and operation, requiring a comparative minimum of parts in the herein disclosed apparatus and a comparative minimum of straightforward operating steps to efficiently and economically carry out the novel disclosed method.

Various other features of the present invention will become obvious to one skilled in the art upon reading the inventive disclosure set forth herein.

SUMMARY OF THE INVENTION

More particularly, the present invention provides a cutlery sharpening device for sharpening a cutlery blade edge comprising: an abrasive edge sharpening means; track means positioned in cooperative relation adjacent the abrasive edge sharpening means; carriage means reciprocatively mounted on the track means to be selectively moved in a predetermined path relative the abrasive edge sharpening means; cutlery holding means pivotally mounted on the carriage means to firmly hold a gripping end portion of a cutlery blade to be sharpened so that said blade can be selectively pivoted into contact with and away from the abrasive edge sharpening means; and, power means to move the carriage means in opposite directions along the track means and pivot the cutlery holding means in a preselected pattern in acccrdance with the position of the carriage means so that a cutlery blade whose gripping portion is firmly held by the holding means can be slidably moved and pivoted into engagement with the abrasive sharpening means to be sharpened thereby along its cutting length when the carriage is moved in one direction and can be pivoted out of engagement with and moved with its cutting length in spaced relation above the abrasive sharpening means when the carriage is moved in an opposite direction.

It is to be understood that various changes can be made by one skilled in the art in any one of the several parts of the apparatus and in any one of the several steps of the method disclosed herein without departing from the scope or spirit of this invention.

BRIEF DESCRIPTION OF THE DRAWINGS

Referring to the drawings which disclose one advantageous embodiment of the invention.

DETAILED DESCRIPTION OF THE DRAWINGS

Figure 1:
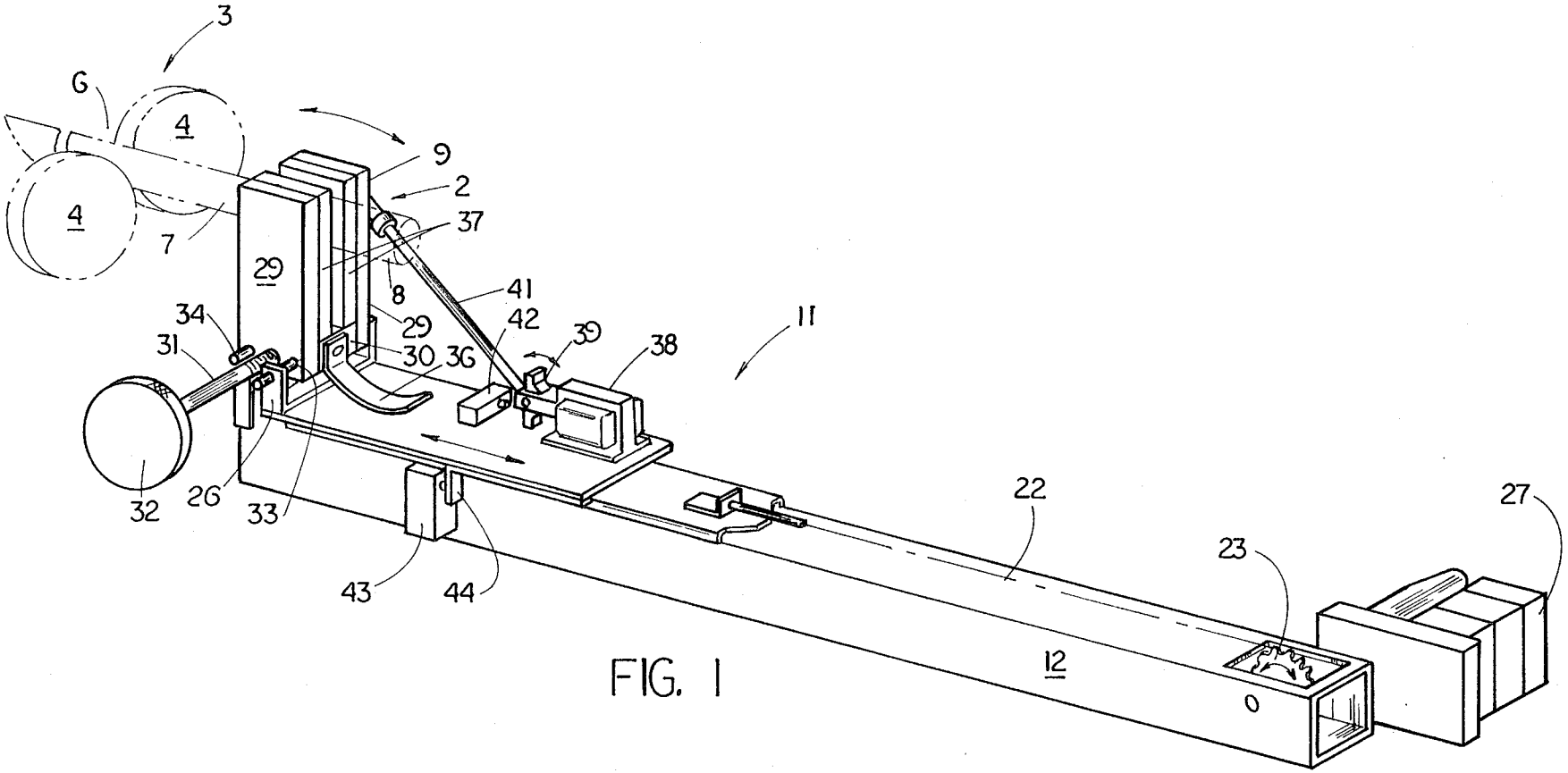
FIG. 1 is an isometric view of one advantageous embodiment of the apparatus of the present invention, disclosing in phantom a cutlery device in the form of a knife and an abrasive edge sharpening means in the form of opposed grinding wheels defining a sharpening gap therebetween with the knife blade trailing portion resting in such gap.
Figure 2:
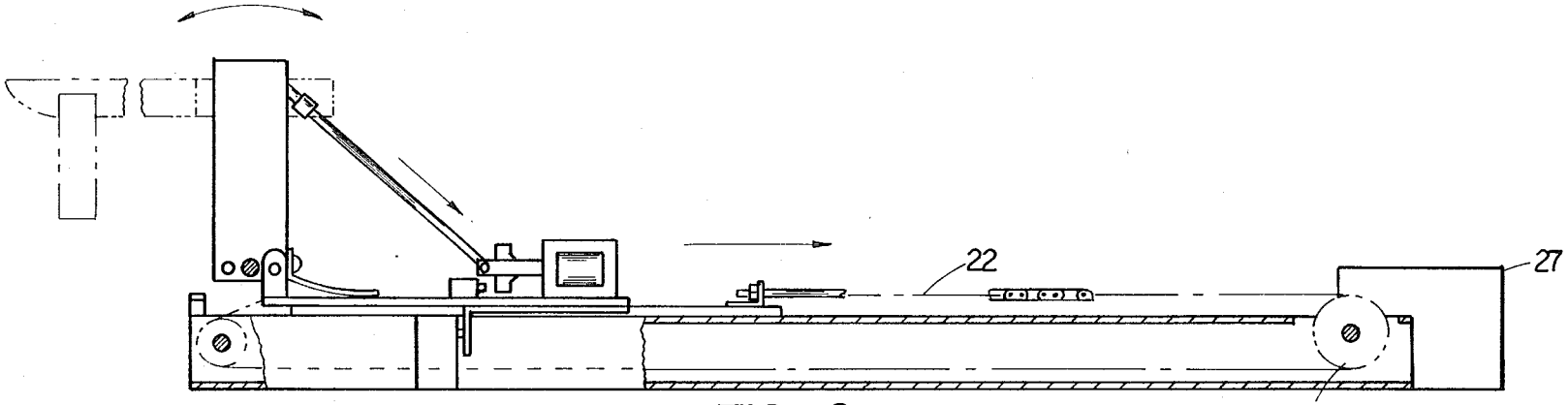
FIG. 2 is a side elevational, partially broken away, view of the apparatus FIG. 1.

Referring to FIG. 1 of the drawings, the novel cutlery sharpening apparatus 2 for sharpening a cutlery blade edge, such as a knife blade edge or the edge of a scissors blade, is shown as including an abrasive edge sharpening means 3 which, in the embodiment of the invention disclosed, is comprised of a pair of rotatable abrasive grinding wheels 4. Advantageously, the peripheral extremities or outer surfaces of abrasive grinding wheels 4 can be disposed in opposed overlapping relation to each other to define an elevated grinding gap 6 which serves to receive and grind to a sharpened edge cutlery blade 7, shown in phantom along with overlapping grinding wheels 4. Blade 7 includes a gripping portion 8 which is gripped and supported by an adjustable vise 9—details of which are described hereinafter.

Figure 4:
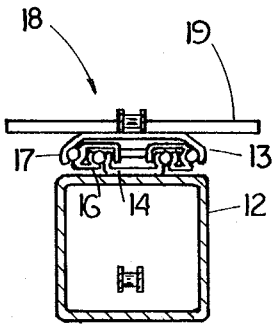
FIG. 4 is a cross-sectional view taken in a plane through line 3—3 of FIG. 3 disclosing the telescoping track arrangement.
Figure 3:
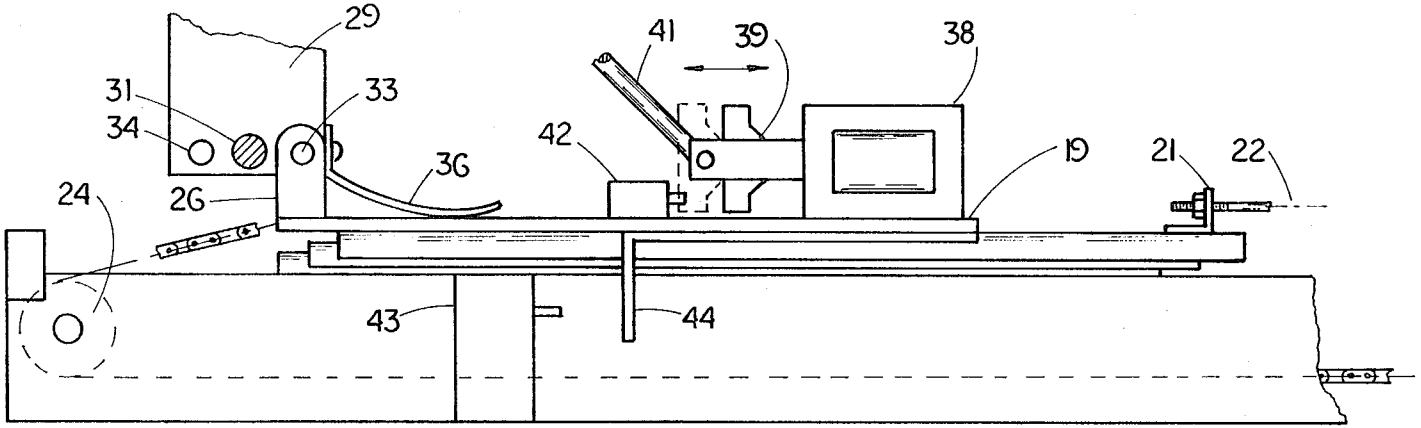
FIG. 3 is an enlarged side elevational view of a portion of the apparatus of FIGS. 1 and 2.
Figure 5:
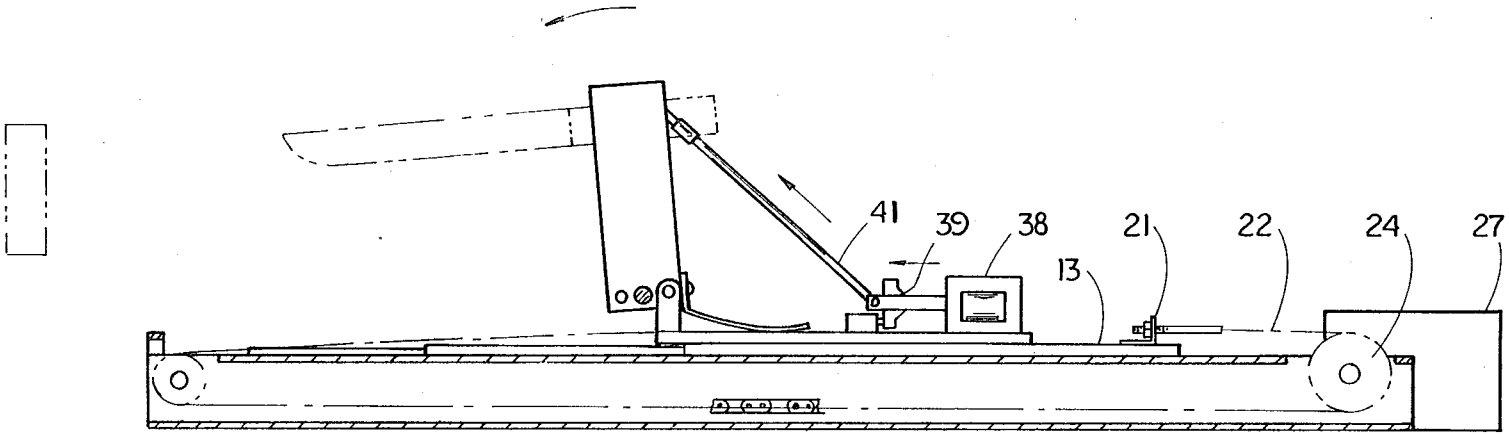
FIG. 5 is a side elevational view similar to that of FIG. 2 disclosing the knife blade leading edge portion having moved past the sharpening gap and pivoted to a downward switch actuating position.

Arranged to be positioned with respect to elevated grinding gap 6 in accordance with the size and geometry of the cutlery blades to be sharpened is a portable cutlery support and transport assembly 11. Assembly 11 includes a longitudinally extending housing 12 on the roof of which is mounted the track means 13. To minimize overall space requirements and to accommodate for varying cutlery blade lengths, track assembly means 13 can be formed from several longitudinally extending telescoping track members 14, 16 and 17 (FIGS. 3 and 4), the base track member 14 being fastened to the roof of housing 12 with intermediate track member 16 and top track member 17 being slidably mounted thereon in a successively stacked slide assembly. This telescoping track arrangement can be of a commercial type, such as Grant Model No. 4930, sold by the Grant Hardware Company, a division of Grant Industries Inc. The top track or slide member 17 has carriage means 18 mounted thereon. Carriage means 18 includes a base carriage plate 19 fixed to top track member 17, track member 17 being connected at its trailing end through the upright leg of right angle bracket 21 to one end of drive chain 22. The other leg of bracket 21 is fixed to the trailing end of track member 17. Chain 22 is arranged to extend over drive sprocket 23 rotatably mounted at one end of housing 12 through housing 12 over idler sprocket 24 rotatably mounted at the other end of housing 12. The opposite end of chain 22 is connected to U-shaped bracket 26, the base of which bracket is fastened to the leading end of carriage plate 19. A suitable reversible motor 27, having electrical connections MR and MF for forward and reverse movement respectively, serves to drive the drive sprocket 23 to thus move carriage plate 19 in back and forth directions on track assembly means 13 in a manner described more fully hereinafter.

Pivotally mounted between the legs of U-shaped bracket 26 on carriage plate 19 is cutlery holding assembly 9 in the form of an adjustable vise having opposed parallel gripping jaws 29 relatively adjustable to move toward and away from each other by means of oppositely threaded pin 31 passing centrally through the lower ends of jaws 29 and mounting block 28 in oppositely threaded relation therewith. A manual gripping wheel 32 having a knurled peripheral surface is fastened to one end of threaded pin 31 to permit for rotation of pin 31 to allow in-and-out adjustment of opposed jaws 29. It is to be noted that the lower ends of opposed jaws 29 have two pins 33 and 34, each passing therethrough and through block 28 in spaced parallel relation to adjusting pin 31. The opposed ends of pin 33 are connected to the opposed upright legs of U-shaped bracket 26, pin 33 thus serving as a pivot pin for opposed jaws 29 and block 28 and pin 34 serving as a guide or jaw stabilizing pin. Mounted to and extending between the rear face of mounting block 28 and the upper face of carriage plate 21 is a leaf spring 36, the spring 36 serving to urge opposed jaws 29 in a yielding forward and downward direction, as will be described hereinafter. It also is to be noted that the inner faces of opposed jaws 29 can be lined with suitable resilient gripping pads 37 to firmly grip the handle or gripping portion of a cutlery blade without injuring the same.

Positioned at the trailing end of carriage plate 19 is a solenoid 38 having a movable plunger or armature 39 disposed in the coil thereof. Connected to the free end of plunger 39 is one end of a linkage member 41, the other end of linkage member 41 being fastened to the upper portion of one of the opposed gripping jaws 29, the plunger 39 and linkage 41 serving to move jaws 29 in a rearwardly and upwardly lifting direction against the action of leaf spring 31.

To control the direction of movement of reversing motor 27 and thus the direction of movement of carriage assembly 18 powered thereby and to control the direction of movement of armature 39 of solenoid 38, two switch members, normally open carriage switch 42 and normally closed side housing switch 43 are provided. Carriage switch 42 is mounted on carriage plate 19 in spaced relation from solenoid 38 to be actuated by armature 39 when cutlery holding assembly 9 has pivoted by gravity downwardly and forwardly a sufficient distance to permit armature 39 to contact carriage switch 42. Side housing switch 43 is selectively positioned along a forward side of housing 12 to be activated by downwardly extending activating arm 44 mounted on carriage plate 39 when plate 19 has been moved to a preselected forward position by motor 27.

Figure 6:
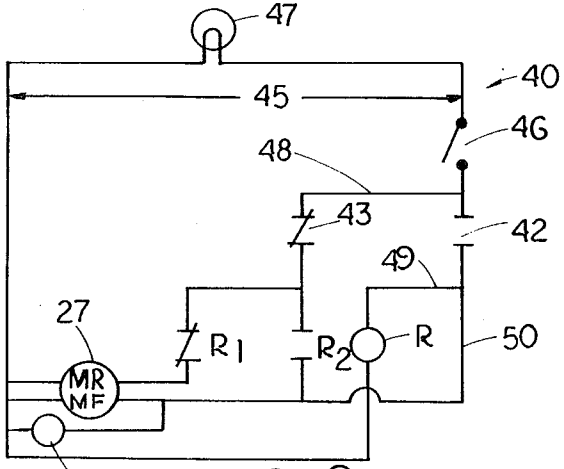
FIG. 6 is an abbreviated schematic view of an electrical circuit which can be employed with the inventive apparatus of FIGS. 1–5 in one manner of carrying out the inventive method of FIG. 7; and, FIG. 7 is a schematic side elevational view schematically illustrating in seven sequential views the inventive knife sharpening method.

Referring to FIG. 6 of the drawings, this figure discloses an abbreviated schematic circuit 40 which can be employed with normally open carriage switch 42 and normally closed side housing switch 43. A suitable power source of 110 volts can be brought into circuit 40 across main line 45, manually operated main power switch 46 being closed when light 47 indicates that appropriate power is being supplied to the circuit for operation. With switch 46 closed, carriage switch 42 in its normally open position and side housing switch 43 in its normally closed position, current is fed through line 48 through normally closed relay switch $R_l$ to operate motor connections MR of motor 27 in a reverse direction bringing a cutlery blade 7 with its handle 8 gripped by jaws 29 of vise 9 carried on carriage plate 19, through gap 6, the blade edge being yieldingly held in contact by spring 36 with abrasive wheels 4. When the blade 7 passes grinding wheels 4, it drops downwardly to close normally open switch 42; this in turn causes relay R to be actuated along line 49, opening normally closed switch $R_l$ to open motor connections MR and stop movement of motor 27 in a reverse direction. At the same time, normally open contact $R_2$ in line 48 is closed and motor connections MF of motor 27 are actuated to move the motor 27 in a forward direction. Also, solenoid 38 parallel with motor connections MF of motor 27 is energized to move actuating arm 39 away from carriage switch 42, opening line 49 with current still flowing to relay R through line 48, normally closed switch 43, closed contact $R_2$ and line 50. When actuating arm 39 is moved away from switch 42 by solenoid 38, linkage 41 is moved to pivotally raise vise 9 and blade 7 held thereby. At the same time carriage 19 is moved in a forward direction by motor 27 through energization of motor connections MF with blade 7 held above gap 6 and the blade edge out of contact with grinding wheels 4. When carriage 19 reaches a position where the trailing edge of the blade 7 is above gap 6, the carriage lever 44 strikes switch 43 momentarily opening this normally closed switch to break connections with MF and solenoid 38 and then normally closing to repeat the sharpening cycle above-described. It is to be understood that, although not shown, a suitable counter can be included in the main line 44 of the circuit to regulate the number of strokes in the sharpening cycle. It also is to be understood that a suitable delay or delays (also not shown) can be built into the circuit to insure reverse movement of motor 27 before the trailing edge of knife 7 is moved to engage in gap 6 for the sharpening stroke of a cycle by grinding wheels 4.

Figure 7:
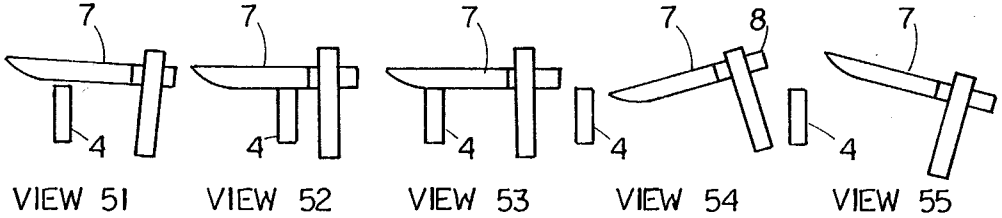

Referring to FIG. 7, five separate views are disclosed wherein the several steps of the inventive method of sharpening the edge of a cutlery blade 7 are disclosed schematically. In view 51, the trailing portion of the blade edge of blade 7 is shown held by a vise 9 above an abrasive grinding surface 4. In view 52, it is shown pivoted into yielding contact with abrasive surface 4. In view 53, the blade edge of blade 7 is shown moving from the trailing portion thereof to the leading portion thereof in yielding stroke contact along abrasive sharpening surface 4. In view 54, the blade edge is shown as pivoted downwardly after the leading portion has passed sharpening surface 4. And, in view 55, the blade edge is shown as having been pivoted upwardly to be free from contact with sharpening surface 4 as it is moved in a reverse direction over surface 4 until its trailing portion has reached the starting position (view 51) for a further sharpening stroke of a cycle. It is to be understood that any number of known grinding surfaces can be utilized in the aforedescribed series of steps and advantageously, the blade can be sharpened between opposed grinding surfaces forming a gap therebetween through which the blade is moved. It also is to be understood that, as abovementioned, the number of sharpening cycles can be selectively controlled to provide a predetermined number of sharpening strokes and that the leading portion of the blade edge can be pivoted mechanically when free of abrasive surface contact or allowed to be pivoted downwardly by gravity, then pivoted upwardly and moved in a reverse direction free of abrasive surface contact before the trailing portion of the blade edge is again brought into abrasive surface contact to repeat the sharpening stroke of a cycle.

The invention claimed is:

1. Cutlery sharpening apparatus for sharpening a cutlery blade edge comprising:

an abrasive edge sharpening means, said edge sharpening means being mounted in preselected stationary position to define a rotating grinding surface;

track means positioned in cooperative relation adjacent said abrasive sharpening means;

cariage means reciprocatively mounted on said track means to be selectively moved in a predetermined path relative to said abrasive edge sharpening means;

cutlery holding means pivotally mounted on said carriage means to firmly and releasably hold in cantilever fashion a gripping end portion of a cutlery blade to be sharpened so that said blade can be selectively pivoted above, into contact with and said pivoted away from said abrasive edge sharpening means; and, power means to move said carriage means opposite directions along said track means and pivot said cutlery holding means in a preselected pattern in accordance with the position of said carriage means so that a cutlery blade whose gripping portion is firmly held by said holding means can be slidably moved above and pivoted into engagement with said preselected stationary abrasive sharpening means defining said rotating grinding surface to be sharpened thereby along its cutting length when said carriage is moved in one direction along said grinding surface and can be pivoted out of engagement with and moved with its cutting length in spaced relation above said preselected stationary abrasive sharpening means defining said rotating grinding surface when said carriage is moved in an opposite direction.

2. The cutlery sharpening apparatus of claim 1, said abrasive edge sharpening means including a pair of rotatable grinding wheels disposed in preselected positional relation to each other to define a rotating grinding surface gap for grinding and sharpening a cutlery blade edge therebetween.

3. The cutlery sharpening apparatus of claim 1, said track means being portable for movement and positioning with respect to said abrasive edge sharpening means in accordance with the cutlery blade to be sharpened.

4. The cutlery sharpening apparatus of claim 1, said track means including a plurality of telescoping track members to accommodate for varying cutlery blade lengths and to minimize overall space requirements.

5. The cutlery sharpening apparatus of claim 1, said carriage means including an actuating member mounted thereon, said actuating member being connected to said pivotal cutlery holding means and to said power means to impart pivotal movement to said cutlery holding means in a preselected sequence in accordance with the position of said carriage means on said track means.

6. The cutlery sharpening apparatus of claim 1, said cutlery holding means including a spring member cooperative with said pivotally mounted holding means to urge a cutlery blade whose gripping end portion is held in cantilever fashion thereby into resiliently yielding contact against said rotating grinding surface of said abrasive edge sharpening means when said pivotal cutlery holding means is accordingly so pivoted into engagement with said abrasive edge sharpening means and moved in grinding surface contact therealong.

7. The cutlery sharpening apparatus of claim 1, said cutlery holding means including an adjustable vise having opposed gripping jaws relatively adjustable to grip various sized gripping end portions of cutlery blade units.

8. The cutlery sharpening apparatus of claim 1, said power means including an electrical circuit, said circuit having a reversible motor therein connected to said carriage means to move said carriage means in opposite directions along said track means, said circuit further including an actuating member connected to said pivotal cutlery holding means, switching members to regulate the directions of movement of said carriage means and said pivotal cutlery holding means and counter means to regulate the number of blade sharpening cycles.

9. The cutlery sharpening apparatus of claim 1, said cutlery holding means including a spring member cooperative with said pivotally mounted holding means to urge a cutlery blade whose gripping end portion is held thereby into resiliently yielding contact against said grinding surface of said abrasive edge sharpening means when said pivotal cutlery holding means is accordingly so pivoted and moved in one direction therealong; and, a first switching member included in said power cooperative with said cutlery holding means to be actuated when said cutlery blade passes out of yielding contact with said edge sharpening means to cause said cutlery blade to be pivoted out of engagement with and moved with its cutting length in spaoed relation above said grinding surface of said abrasive sharpening means in an opposite direction; and a second switching member included in said power means cooperative with said carriage to be actuated when the trailing edge of said cutlery blade has moved above and past its sharpening position to reverse the direction of movement of said cutlery blade and to pivot said cutlery blade into grinding surface contact sharpening position relative said abrasive sharpening means.

10. Cutlery sharpening apparatus for sharpening a cutlery blade edge comprising:

a pair of rotatable abrasive grinding wheels with their extremities disposed in opposed overlapping relation to each other to define an elevated grinding gap for grinding and sharpening a cutlery blade edge therebetween;

a portable track member including a plurality of telescoping tracks to be positioned with respect to said grinding gap in accordance with the cutlery blade to be sharpened accommodating for varying blade lengths and minimizing overall space requirements;

a carriage mounted on said portable track;

an adjustable vise having opposed gripping jaws relatively adjustable to grip various sized gripping end portions of cutlery blade units, said vise being pivotally mounted on said carriage;

a solenoid actuating member mounted on said carriage, said solenoid actuating member having a linkage member connecting said solenoid to said adjustable vise to pivot said vise from one position to another;

a leaf spring cooperative between said vise and said carriage to urge a cutlery blade whose gripping end portion is held thereby into yielding contact between said abrasive grinding wheels forming said elevated grinding gap when said vise has been so pivoted and moved in one direction therealong; and, power means including an electrical circuit, said circuit having a reversible motor therein connected by chain linkage to said carriage to move said carriage in opposite directions along said carriage, said circuit including said solenoid actuating member to pivot said vise from one position to another, first and second switches, said first switch being actuable when a cutlery blade falls from yielding contact with said grinding gap and said vise pivots downwardly to cause said blade to be pivoted in a reverse direction out of engagement above said gap and moved with its cutting length in spaced relation above said gap, said second switch being actuated by said carriage when the trailing edge of said cutlery blade has moved above and past said elevated sharpening gap to reverse the direction of movement of said blade and pivot said blade into sharpening contact position, said circuit further including a counter to regulate the number of blade sharpening cycles.

* * * * *